United States Patent [19]

De Graaf

[11] 4,189,179

[45] Feb. 19, 1980

[54] LOW PROFILE CHAIR IRON

[75] Inventor: Clare J. De Graaf, Grand Rapids, Mich.

[73] Assignee: Gordon Manufacturing Company, Grand Rapids, Mich.

[21] Appl. No.: 692,848

[22] Filed: Jun. 4, 1976

[51] Int. Cl.[2] ..... A47C 3/00

[52] U.S. Cl. ..... 297/305

[58] Field of Search ..... 297/305, 304, 300, 266, 297/267, 302; 248/380, 381, 386, 388, 379

[56] References Cited

U.S. PATENT DOCUMENTS

| | | | |
|---|---|---|---|
| 92,787 | 7/1869 | Bradway | 5/256 |
| 354,039 | 12/1886 | Bunker | 297/266 |
| 380,651 | 4/1888 | Fowler | 5/256 |
| 405,530 | 6/1889 | Bunker | 297/265 |
| 409,509 | 8/1889 | Shults | 297/266 |
| 452,686 | 5/1891 | Adams et al. | 248/381 |
| 622,073 | 3/1899 | Quinlan | 248/381 |
| 1,097,361 | 5/1914 | Persons | 248/388 |
| 2,678,082 | 5/1954 | Walker | 248/388 |
| 2,729,273 | 1/1956 | Hamilton et al. | 248/379 |
| 2,743,104 | 4/1956 | Dodson | 248/388 X |
| 3,339,973 | 9/1967 | Doerner | 297/300 |
| 3,656,805 | 4/1972 | Engstrom | 297/302 |

*Primary Examiner*—Francis K. Zugel
*Attorney, Agent, or Firm*—John E. McGarry

[57] ABSTRACT

A low profile chair iron for controlling biased tilting between a seat or backrest and a support uses a substantially flat coil spring of increasingly smaller diameter coils between pivotably connected support bracket and a chair part bracket. Tension adjusting means for the spring are pivotably mounted with respect to the central coils of the spring and/or support bracket for minimizing nonuniform loading of the spring during the pivotable movement of the chair part bracket with respect to the support bracket.

18 Claims, 12 Drawing Figures

LOW PROFILE CHAIR IRON

BACKGROUND OF THE INVENTION

1. Field of the Invention

This invention relates to chair irons. In one embodiment, the invention relates to a low profile chair iron useful for controlling tilting between a seat and a supporting base therefor. In another of its aspects, the invention relates to a low profile chair iron useful for controlling tilting of the chair backrest with respect to the chair seat and/or supporting base therefor.

2. State of the Prior Art

In the office equipment field, chairs having tilt mechanisms are common. Typically, the chairs are supported on wheeled pedestal bases. The mechanism, which couples the base to the seat is known as a "chair iron." In tilting chairs, the chair iron typically includes a threaded spindle rod extending upwardly from a wheeled multiple foot base, a collar threaded on the spindle for adjusting the vertical position of the chair, a first bracket rigidly secured to the underside of the chair and a second bracket pivotably mounted to the first bracket and rigidly secured to the spindle. In the case of a secretarial or posture chair, the one bracket is secured to a backrest and the second bracket is secured to the spindle or seat. The brackets are biased with respect to one another about the pivot axis and tilting takes place against the bias.

Many different techniques have been employed for biasing the brackets with respect to one another. Cylindrical coil springs, for example, are common and are illustrated in the U.S. Pat. to Hamilton, No. 2,729,273 (issued Jan. 3, 1956). The U.S. patent to Engstrom, No. 3,656,805 (issued Apr. 18, 1972), discloses a similar type of chair iron which uses a frustroconically shaped spring.

In recent years, it has become more important to provide a low profile to the chair iron to give a more sleek appearance to the chair assembly. The chair irons employing the cylindrical coil spring types of biasing means are generally more bulky and crude in appearance with the coil spring being visible.

Accordingly, a number of different types of chair irons have been developed to achieve a low, sleek profile. Torsion bars have proved to be a popular type of biasing means. An example of a torsion bar chair iron is illustrated in U.S. Pat. No. 2,935,119 to Lie issued May 3, 1960. Although it is low in height, the torsion bar chair iron is quite wide and has a bar extending out of each end thereof. This wide structure is becoming less desirable in curved bottom plastic shell chairs.

Other types of lower profile chair irons include rubber bushed or coil springs wrapped around the pivot bolt between the tilting and stationary brackets. Examples of these types of chair irons are illustrated in U.S. Pat. No. 3,881,772, issued May 6, 1975.

Flat leaf spring chair irons have also been used to provide the biasing between the tilting and stationary brackets. These types of chair irons are illustrated in U.S. Pats. Nos. 391,822 (issued Oct. 30, 1888), 2,818,911 (issued Jan. 7, 1958), 3,693,925 (issued Sept. 26, 1972).

Other types of chair irons have taken completely different forms. A cylindrical coil spring wrapped around a spindle and positioned within a telescoping housing is used to bias a tilting bracket with respect to the fixed bracket in U.S. Pat. No. 3,720,396, issued Mar. 13, 1973. The use of spring compression washers to bias the tilting bracket with respect to the fixed bracket is illustrated in the U.S. Pat. No. 3,814,369, issued June 4, 1974. The use of C-shaped flat springs as biasing means between the tilting and fixed brackets is disclosed in U.S. Pat. No. 3,284,133, issued Nov. 8, 1966. The use of a C-shaped leaf spring construction for the tilt bias is illustrated in U.S. Pat. No. 3,740,792, issued June 26, 1973.

Each of these chair irons disclosed is relatively expensive to produce or has some degree of difficulty in adjusting the tension within the biasing means. Further these chair irons, other than the torsion bar type, cannot practically achieve an acceptable low profile for more modern chairs.

SUMMARY OF THE INVENTION

The chair iron according to the invention is easily adjustable, has a low profile, is reliable in operation and relatively inexpensive to manufacture. The chair iron according to the invention can be used to control the tilting between the seat and the support or to control tilting between a backrest and seat.

According to the invention, a chair iron for controlling the tilting of a first chair part with respect to a support means has a first bracket means adapted to be connected to the first chair part, a second bracket means adapted to be connected to a support base, means pivotably mounting the first bracket means with respect to the second bracket means, and means for biasing the first bracket with respect to the second bracket to a given rest position. The biasing means is a substantially flat coil spring connected to the first and second bracket means such that the coil spring is extended axially during tilting of the first bracket means with respect to the second bracket means. The flat coil spring provides a low profile chair iron which in certain preferred embodiments conceals the coil spring. Thus, the chair iron has the advantages of a coil spring, which is inexpensive to manufacture and durable in operation and avoids the disadvantage of the unsightly coil spring projecting out of the bottom of the chair iron.

Desirably, means mount the outer portion of the coil spring on the first bracket means. The central portion of the spring is coupled to the second bracket means such that the spring outer portion is moved away from the second bracket against the tension in the spring as the first bracket means pivots with respect to the second bracket means. In preferred embodiments, the central portion of the spring is raised with respect to the outer portion thereof and projects away from the second bracket whereby the central portion of the spring moves through the outer portion of the spring as the first bracket means pivots with respect to the second bracket means. The first bracket means and the outer spring portion mounting are shaped so as to prevent passage of the spring's central portion therethrough and axially with respect thereto during the tilting operation. The coupling between the central portion of the spring and the second bracket means includes a tension adjusting means which can include a threaded bolt, the head of which is retained by the central portion of the spring and a handle which is positioned in abutting relationship to the second bracket means. Means are provided for guiding rotation of the tension adjusting means with respect to the second bracket means during the tilting operation and as the axis of the spring changes to maximize uniform loading of the spring during the tilting operation.

In a preferred embodiment of the invention, the second bracket means is mounted to a spindle and the plane incorporating the spring outer portion is positioned at an acute angle with respect to a horizontal plane when the first bracket means is in the given rest position. As the first bracket means tilts, the plane of the outer spring portion rotates with respect to the horizontal plane and with respect to the second bracket means such that the angle of the spring outer portion plane with the horizontal plane decreases to zero and then increases to a positive angle during the tilting operation. In this manner, the spring is loaded unevenly during the initial stages of pivoting but is loaded more evenly as pivoting reaches the maximum tilt angle.

In other forms of the invention, the outer portion of the spring is mounted on the second bracket means and the central portion of the spring is coupled to the first bracket means. In some of these other embodiments, means are provided on the second bracket means to permit passage of the central portion of the spring therethrough as the first bracket means tilts with respect to the second bracket means such that the central portion of the spring is moved through the outer portion of the spring and through portions of the second bracket means during tilting of the first bracket means with respect to the second bracket means.

In more preferred forms of the invention, the first and second bracket means conceal the spring therebetween.

In certain embodiments of the invention, the chair iron is used to bias tilting between a seat and a base. In other embodiments of the invention, the chair iron is used to bias tilting between a backrest and a seat as is common in posture-type chairs and secretarial-type chairs.

The spiral coil spring used in the invention desirably has a central portion which is raised above outer portions thereof to form a slight axial taper to the spring. However, the height-to-diameter ratio of the spring is significantly less than 1. The slight height to the spring provides in certain embodiments a technique whereby the axial height of the spring at full extension can be lessened by pulling the central portion of the spring back through the outer portions thereof during the tilting operation.

BRIEF DESCRIPTION OF THE DRAWINGS

The invention will now be described with reference to the accompanying drawings in which.

DESCRIPTION OF THE PREFERRED EMBODIMENTS

Figure 1:
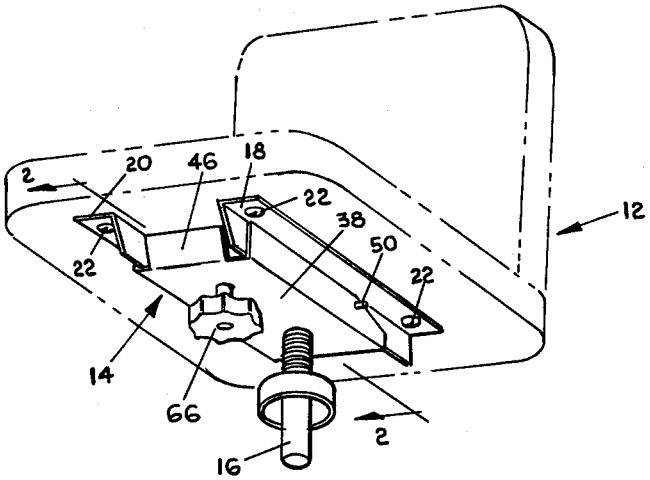
FIG. 1 is a perspective view of a bottom of a chair incorporating a chair iron according to the invention.

Referring now to the drawings and to FIGS. 1 through 4 in particular, there is shown a chair 12 having secured to the bottom thereof a chair iron 14 comprising spindle 16, seat brackets 18 and 20 and spindle bracket 38. Normally, the spindle 16 is received within a multileg chair base (not shown) to support the chair. The seat brackets 18 and 20 are secured to the bottom of the chair in conventional fashion with screws or other suitable fasteners.

The seat brackets 18 and 20 have notched rear ends 34 with an inwardly bent stop tab 36 at rear portions thereof.

A spring bracket 24 having an upstanding front lip 26 and upstanding side walls 30 is secured to the seat brackets 18 and 20 through rivets 32 which extend through the side walls 30 and through the depending flanges of the seat brackets 18 and 20. An opening 28 is provided in the bottom of the spring bracket 24.

The spindle bracket 38 has sloping rear flanges 40 on which are positioned rubber pads 42. The spindle 16 extends through the bottom of the spindle bracket 38 and is secured thereto in conventional fashion by a U-shaped mounting bracket 44. Rivets secure the mounting bracket 44 to the bottom of the spindle 38 in conventional fashion. Typically, the spindle is mounted at a slight forward angle, for example 4° to the vertical.

An upwardly sloping front wall 46 is formed at the front of the spindle bracket 38 to conceal the spring bracket 24. The front wall 46 also prevents accidental pinching of fingers and the like during tilting of the chair mechanism.

Side flanges 48 extend upwardly at the sides of the spindle bracket 38. A pivot bolt 50 extends through the side flanges 48 and through the depending flanges of the seat brackets 18 and 20 to pivotably mount the seat brackets 18 and 20 with respect to the spindle bracket 38. The pivot bolt 50 is mounted forwardly of the spindle 16 in the chair bracket so that the spindle is more completely hidden in the control to maintain a more thin profile of the chair iron. Further, the mounting of the pivot bolt 50 forwardly of the spindle 16 adds to the stability of the chair with respect to the base on which the spindle is mounted. A bolt opening 52 is provided at the bottom of the spindle bracket 38. Rounded bosses 54 are stamped in the spindle bracket 38 at either side of the opening 52.

Figure 2:
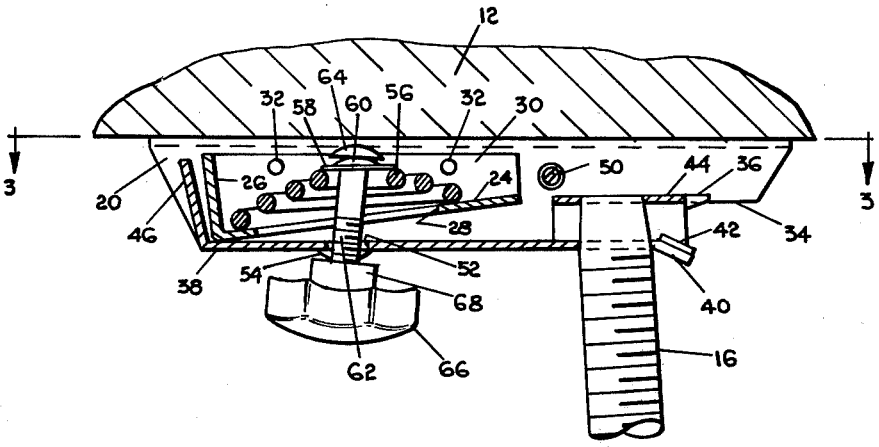
FIG. 2 is a side elevational view in section taken along lines 2—2 of FIG. 1.
Figure 3:
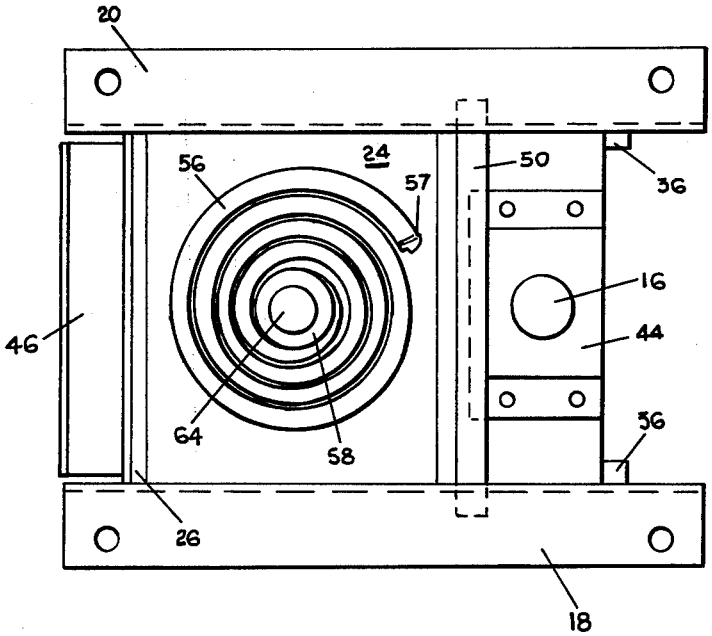
FIG. 3 is a top view of the chair iron illustrated in FIGS. 1 and 2 and seen along lines 3—3 of FIG. 2.

A flat spiral spring is mounted with its base secured to the spring bracket 24 through weld 57. As seen in FIG. 2, the spring 56 is substantially flat but has a slight upward axial taper. As seen in FIG. 3, the spring is spiral in the sense that it coils inwardly such that each coil is progressively smaller so that at least central portions of the coil can pass through the plane of outer coils.

As seen in FIGS. 2 and 3, the central axis of the spring 56 is substantially perpendicular to the axis of the pivot bolt 50.

A washer 58 having a convex rounded central surface 60 abuts the top and inner coils of spring 56. The rounded central surface 60 of the washer 58 is spherically shaped. The carriage bolt 62 extends through opening 52 in the spindle bracket 38 and through the center of the spiral spring 56. The head 64 of the carriage bolt 62 abuts against the convex sperical surface 60 of washer 58. A handle 66 having a threaded member 58 threadably engages the threaded end of the carriage bolt 62. The threaded member 68 has an upper flat surface which abuts the rounded bosses 54 adjacent to the bolt opening 52. The carriage bolt 62 is normally positioned at about a 4° angle in a clockwise direction from the vertical about handle 66.

Figure 4:
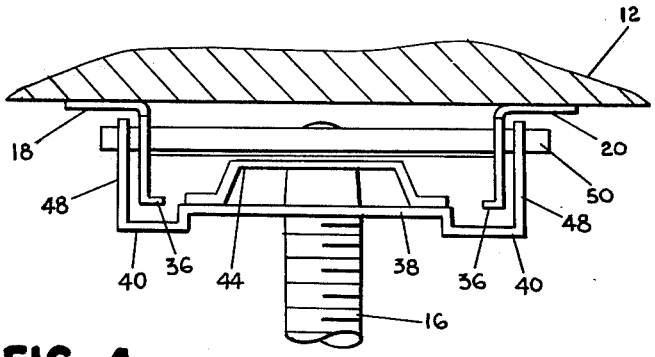
FIG. 4 is a rear elevational view of the chair iron illustrated in FIGS. 1 through 3.

In operation, the spring 56 biases the seat brackets 18 and 20 and therefore the seat 12 in a counterclockwise direction as viewed in FIGS. 2 and 4 with respect to the spindle bracket 38. The forward end of the spring bracket 24 rests against the bottom of the spindle bracket 38 in this position. In the position illustrated in FIG. 2, the bolt 62 will have a slight angular pitch forward with respect to the vertical. For example, the carriage bolt may be positioned at an angle of 4° with respect to the vertical.

Figure 5:
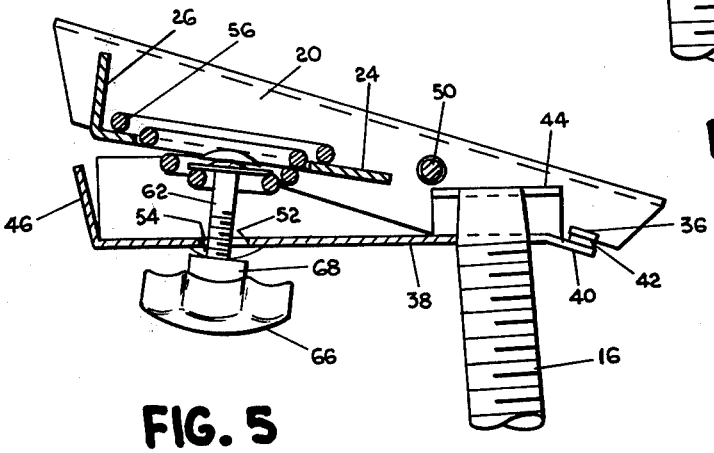
FIG. 5 is a view similar to FIG. 3 of the chair iron illustrated in FIGS. 1 through 4 showing the maximum tilt of the seat with respect to the spindle.

As a chair is tilted for pivotable movement about the pivot bolt 50, the outer coil of the spring 56 will be raised with respect to the inner coils thereof so that the inner coils will actually pass through the plane of the outer coil until the stop tabs 36 abut against the rubber pads 42 on the sloping ends 40 of the spindle bracket 38. In this position, which is the maximum tilt position illustrated in FIG. 5, the spring will actually form an inverted conical shape as the outer portions of the spring are drawn up around and above the inner portions of the spring 56. During this tilting motion, the bolt 62 will rotate in a clockwise direction from a slightly forward position to a rearwardly inclined position such that the bolt is parallel to the axis of the spring 56 as illustrated in FIG. 5. In order to accomplish this result, the upper flat surface of the threaded member 68 will roll on the rounded bosses 54 and the bottom of the carriage bolt 64 will roll on the rounded central surface 60 of washer 58. Thus, as the tilting motion begins, the loading of the spring 56 changes from a position wherein the forward parts of the spring are loaded less than the rear part to a position where all parts of the spring are equally loaded. As the chair begins to tilt, the load on the spring for the first 8°, for example, is unevenly distributed in the front of the spring. However, this is the time at which the least tension is exerted on the spring and therefore the tension does not materially affect the fatigue of the spring. At an 8° tilt, the spring mounting plate 24 and the spindle bracket 38 are parallel with respect to each other but the bolt connecting the spring and handle remains at about a 4° rearward angle. As the chair continues to tilt to about 16°, the bolt will rotate to the position where it is perpendicular to the spring mounting plate 24. At that point, all stresses on the spring are roughly equal and remain equal as the chair continues to tilt through an additional 6° to the position illustrated in FIG. 5. Thus, during the positions at which the spring is most heavily loaded, i.e. between 12° and 18° tilt, the loading of the spring is substantially uniform and fatigue on the spring is minimized.

Figure 6:
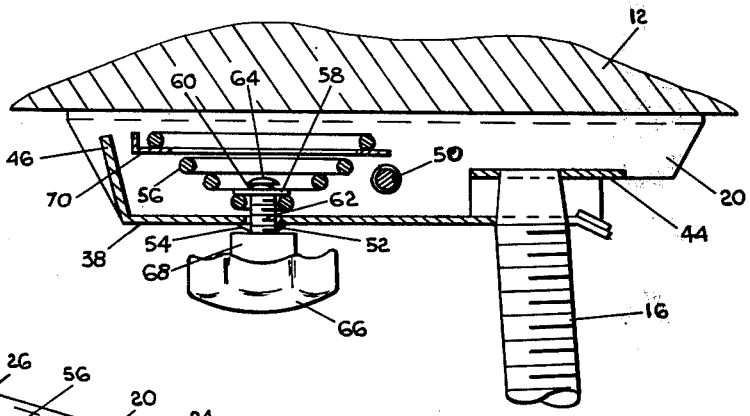
FIG. 6 is a view similar to FIG. 2 of a modified form of the invention.

Reference is now made to FIG. 6 for a description of the second embodiment of the invention. In this drawing like numerals are used to designate like parts. In this embodiment, the spring 56 is used wholely as a tension spring. In this embodiment, the base of spring 56 is mounted on spring mounting plate 70 having an opening therein through which the lower coils of the spring may pass. The spring mounting plate 70 is pitched at a slight negative angle with respect to a horizontal plane. The base of the spring is retained on the top of the spring mounting plate 70. The spring mounting plate 70 extends downwardly and forwardly with respect to the seat 12 and with respect to the spindle bracket 38 when in the position illustrated in FIG. 6.

A carriage bolt 62 having a head 64 extends through the opening 52 in the spindle bracket 38 and is retained on the inner coils of the spring 56 by washer 58. A rounded central portion 60 is provided on washer 68 for rotation of the carriage bolt head 64 with respect to the washer 58 during tilting of the chair.

As in the preferred embodiment, the handle 66 has a collar 68 which threadably engages the carriage bolt 62. Rounded bosses 54 are provided on the bottom of the spindle bracket 38 to provide rolling of the flat upper surface of the handle collar 68 thereon during tilting of the chair 12 about the pivot bolt 50.

The embodiment of FIG. 6 operates in a slightly different manner than the embodiments shown in FIGS. 1 through 5. In this embodiment, the tension in spring 56 biases the chair forwardly in the position illustrated in FIG. 6 with the downwardly extending flanges of the seat brackets 18 and 20 contacting the spindle bracket 38. As the chair is tilted in a clockwise direction as viewed in FIG. 6 about the pivot bolt 50, the spring mounting plate 70 will raise the base of the spring 56, thereby applying increasing amounts of tension in the spring 56. As rotation continues to an angle of about 18° of the chair base with respect to the horizontal, the spring plate 70 will rotate about the pivot bolt 50. As this happens, the carriage bolt 62 will likewise rotate with the head 64 rolling on the rounded central portion 60 of washer 58 and the threaded handle collar rolling about the rounded bosses 54. In this manner, tension is maintained relatively uniform in the spring as the spring expands through its maximum height.

Figure 7:
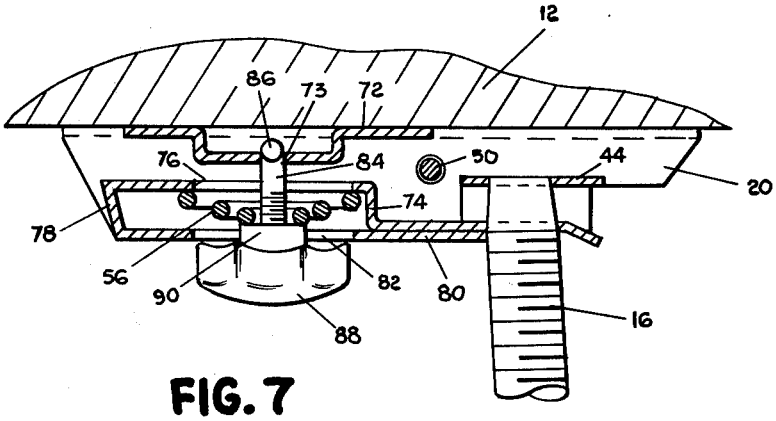
FIG. 7 is a view similar to FIG. 2 of a second modified form of the invention.

Referring now to FIG. 7, there is shown a third embodiment of the invention. In this figure, like numerals have been used to designate like parts. A bolt bracket 72 is provided between the chair bracket 20, only one of which is shown in FIG. 7. The bolt bracket 72 has a slight recess in which a bolt opening 73 is formed.

A spindle bracket 74 is secured to the spindle 16 through a U-shaped mounting bracket 44. The spindle bracket 74 has an upward indentation or spring cavity in which is positioned the flat spiral spring 56. A spring opening 76 is provided in the indentation of spindle bracket 74. A depending front shield 78 and a bottom plate 80 enclose the flat spring 56. A handle opening 82 is provided in the bottom plate 80 to permit passage of a handle 88 of a threaded bolt 82. A crossbar 86 is welded to the top of the threaded bolt 84 and is pivotably mounted within the bolt opening 73 of the bolt bracket 72. A collar 90 of handle 88 threadably engages the threads of the bolt 84 and retains the inner coils of the spring 56.

In operation of the embodiment illustrated in FIG. 7, the tension in the spring 56 biases the seat in a forward position with respect to the spindle bracket 74 to maintain the position illustrated in FIG. 7. As the seat 12 is rotated about the pivot bolt 50, the inner coils of the spring will be drawn upwardly with respect to the spindle bracket 74 with the base or outer coils of the spring 56 being maintained within the cavity of the spindle bracket 74. As the base continues to rotate with respect to the pivot bolt 50, the inner coils of the spring 56 will be drawn through the spring opening 76 in the spindle bracket 74. In this manner, the relatively flat spring is used to maintain the seat bias with respect to spring bracket and to return the seat to its normal position following tilting. During the tilting movement, the bolt 84 rotates about the crossbar 82 to maintain the tension in the spring substantially constant during the tilting operation.

Thus, it can be seen by the foregoing, the relatively flat spring provides a unique and simple technique for biasing the seat with respect to the spindle. The flat spring allows for concealment of the spring and for a very low profile chair iron. The placement of the pivot bolt forwardly of the spindle increases the stability of the chair with respect to the base in that there is not an overcenter type of action as the occupant tilts back on the chair.

Figure 8:
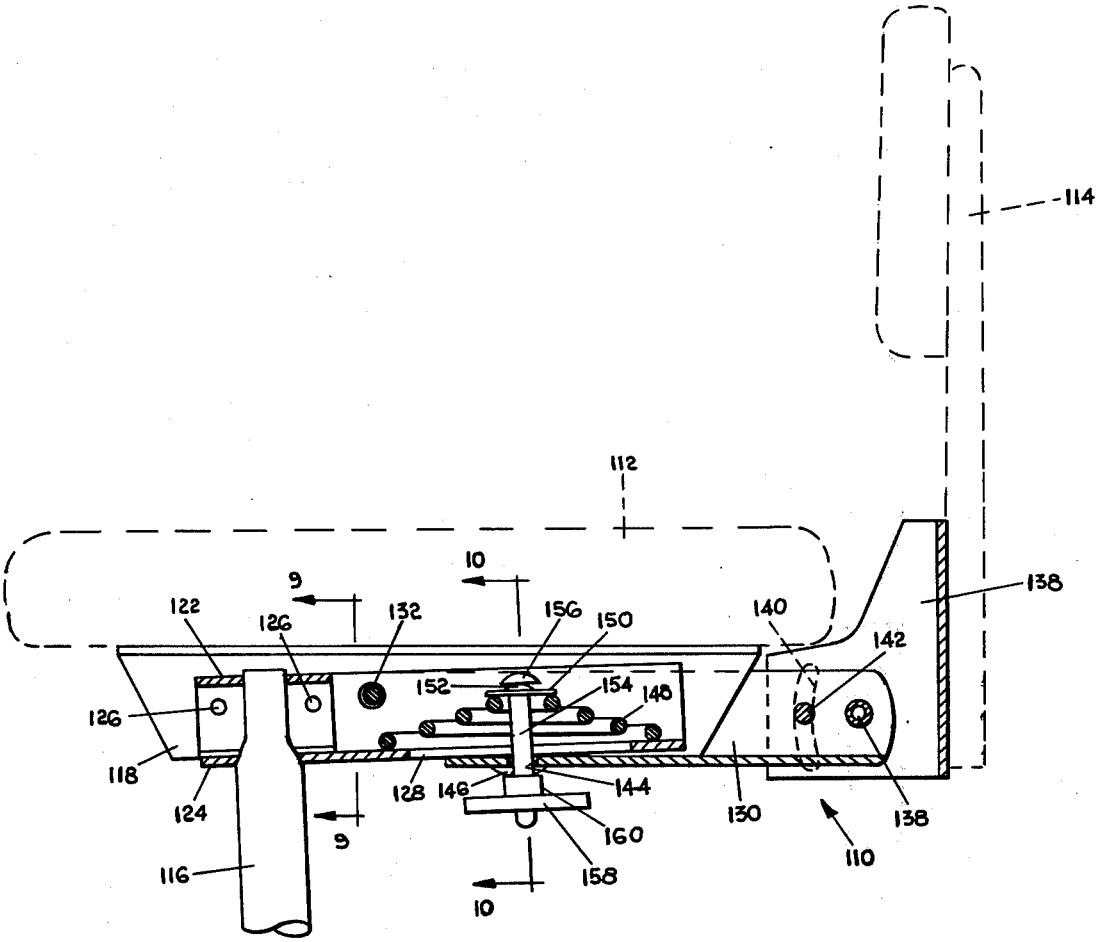
FIG. 8 is a side elevational view in section showing the invention as applied to a backrest control in a chair iron.

Referring now to FIG. 8, there is shown a chair iron 110 which is secured to a seat 112 shown in phantom lines and a backrest support 114 also shown in phantom lines. The seat is fixed with respect to the spindle and the backrest tilts with respect to the seat.

The chair iron 110 comprises a spindle 116 and a pair of L-shaped seat brackets 118 and 120 which are secured to the underside of the seat 112. A pair of U-shaped spindle brackets 122 and 124 have openings which tightly engage the spindle 116 and are secured at the sides thereof to the depending flanges of the seat brackets 118 and 120 through rivets 126. The spindle bracket 124 extends rearwardly of the spindle and contains a relatively large opening 128.

A U-shaped backrest bracket 130 is pivotably mounted to the spindle bracket 124 and to the seat brackets 118 and 120 through pivot bolts 132 and 134.

A U-shaped adjustment bracket is pivotably mounted to the back portion of the backrest bracket 130 through pivot formations 138 in conventional fashion to permit adjustment of the backrest with respect to the seat 112. To this end, the adjustment bracket 136 is provided with slots 140 and an adjustment bolt 142 which locks the bracket 136 in an adjusted position with respect to the backrest bracket 130. The adjustable connection between the adjustment bracket 136 and the backrest bracket 130 is conventional and forms no part of this invention.

A bolt opening 144 having downwardly extending cam surfaces 146 is formed in the bottom of the backrest bracket 130. A relatively flat coil spring 148 is mounted with its outer coil resting on and secured to the spindle bracket 124 and surrounding the opening 128. A retaining washer 150 having an embossed spherical cam surface 152 is positioned on top of the inner coils of the spring 148. A carriage bolt 154 extends through the washer 150 and a head 156 of the carriage bolt 154 abuts the spherical cam surface 152 of washer 150. The carriage bolt 154 further projects through the opening 144 and threadably engages a handle 158 having a collar 160. The flat bottom surface of the collar rides in engagement with the cam surfaces 146 of the backrest bracket 130.

Figure 9:
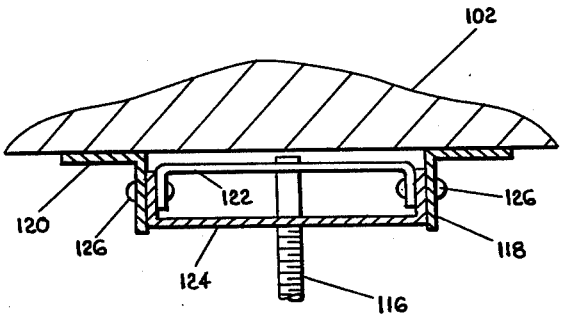
FIG. 9 is a view taken along lines 9—9 of FIG. 8.
Figure 10:
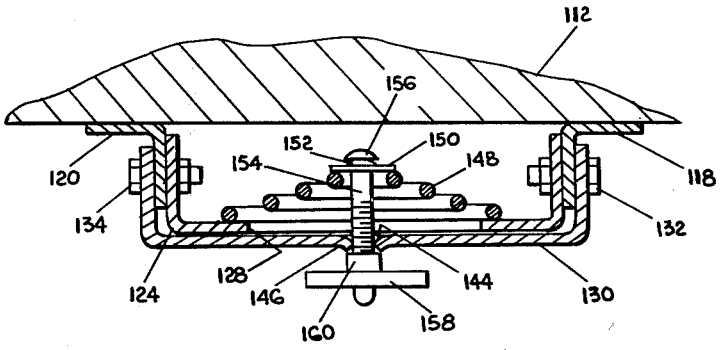
FIG. 10 is a view taken along lines 10—10 of FIG. 8.

The chair iron illustrated in FIGS. 8 through 10 operates as follows: Normally, the backrest bracket 130 will be positioned in the position illustrated in FIGS. 8 through 10. The spring 148 acting against the carriage bolt 154 biases the backrest bracket 130 upwardly, or counterclockwise, about pivot bolt 132 as viewed in FIG. 8. When pressure is applied backwardly on the backrest, the backrest bracket 130 will pivot clockwise as viewed in FIG. 8 about the pivot bolt 132. As this tilting action takes place, the carriage bolt 154 draws the central portions of the spring 148 downwardly with respect to the outer portions thereof. As tilting continues, the central portions of the spring are drawn through the opening 128 in much the same manner as the spring 56 is drawn through the opening 28 in spring mounting plate 24 (See FIG. 5). As the central portion of the spring is drawn downwardly with respect to the outer portions thereof, the tension on the spring increases substantially linearly, thereby providing a continually increasing loading force against the chairback as it tilts with respect to the seat. Upon release of the pressure from the seat, the spring will return to the position illustrated in FIGS. 8 and 10.

Figure 11:
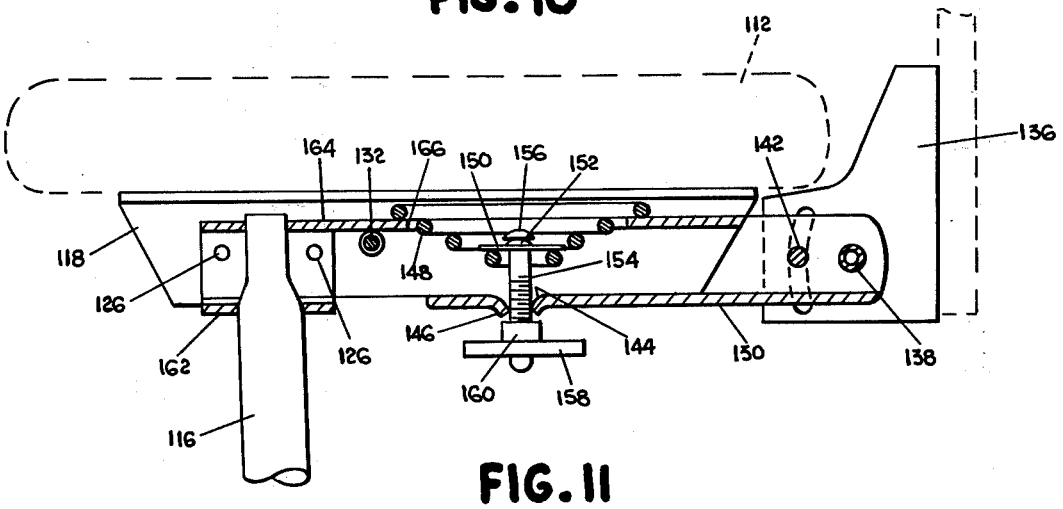
FIG. 11 is a side elevational view in section similar to FIG. 8 and showing a modified form of the invention as applied to a backrest tilt mechanism.

Reference is now made to FIG. 11 which shows a modified form of the invention as used in controlling the tilting of a chairback with respect to the seat. In FIG. 11, like numerals have been used to designate like parts. The spindle 116 is secured to the seat brackets 118 and 120 (not shown) through U-shaped spindle brackets 162 and 164 and through rivets 126. In the embodiment of FIG. 11, the spindle bracket 164 extends rearwardly with respect to spindle bracket 162 and has a relatively large opening 166 therein. In this embodiment, the spring 148 is inverted from the position illustrated in FIGS. 8 through 10 and the outer portions of the spring rest against and are secured to the upper surface of the spindle bracket 164. The central portions of the spring 148 pass through the opening 166. The carriage bolt 154 is coupled to the inner coils of the spring 148 through the retaining washer 150 with the embossed spherical cam 152. The head 156 of carriage bolt 154 abuts the embossed spherical cam 152. The handle 158 threadably engages the bottom of the carriage bolt 154 and the collar 160 of the handle engages the cam surfaces 146 of the backrest bracket 130.

In operation of the chair iron illustrated in FIG. 11, the backrest bracket 130 pivots in a clockwise direction as viewed in FIG. 11 about the pivot bolt 132, thereby drawing the inner portions of the spring 148 downwardly with respect to the outer portions thereof as the backrest is deflected or tilted with respect to the seat 112. During this rotational movement, the loading on the spring is maintained relatively even by virtue of the fact that the head 156 of the carriage bolt 154 rolls on the spherical cam surface 152 and the collar 160 of the handle 158 rolls on the cam surface 156.

Figure 12:
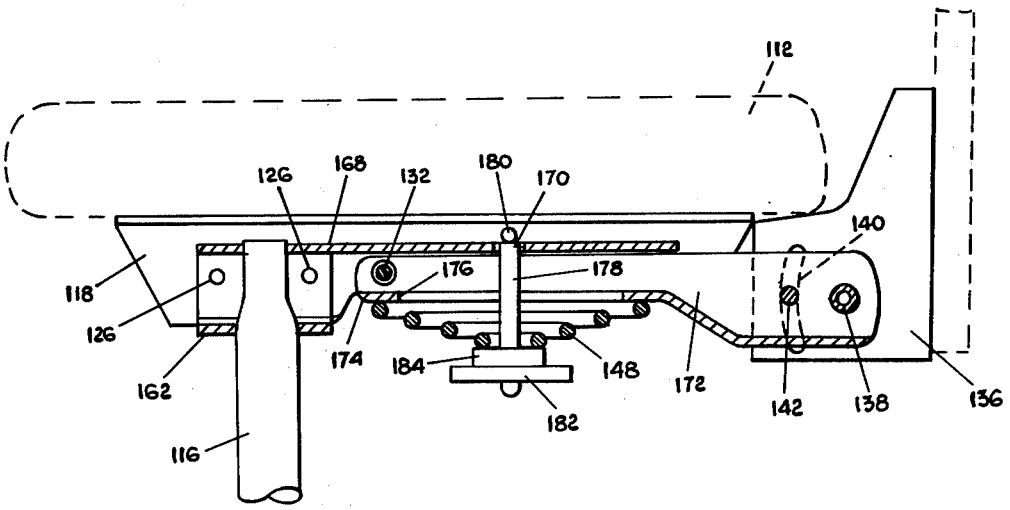
FIG. 12 is a view similar to FIG. 8 showing a second modified form of the invention as applied to a backrest tilt control.

Reference is now made to FIG. 12 for a description of still another embodiment of the invention. In this figure, like numerals have been used to designate like parts. The spindle 116 is secured to the chair seat 112 through a pair of U-shaped brackets 162 and 168, L-shaped seat brackets 118 (only one of which is shown in FIG. 12) and rivets 126 in a manner which has been described with reference to FIGS. 8 through 10. The spindle bracket 168 extends rearwardly of bracket 162 and has an opening 170 near a rear portion thereof. A U-shaped backrest bracket 172 is pivotably mounted to the depending flanges of the seat bracket 118 and to the depending flanges of the spindle bracket 168. A carriage bolt 178 extends through opening 170 of the spindle bracket 168 and has a hook 180 through which the carriage bolt is pivotably retained on the spindle bracket 168. A handle 182 having a collar 184 is threaded onto the bottom of the carriage bolt 178 and receives the central coils of the spring 148. The outer coils of the spring 148 are positioned against the underside of the cross-portion 174 of the U-shaped backrest bracket 172.

In operation of the chair iron illustrated in FIG. 12, as the backrest bracket 172 pivots in a clockwise direction about pivot bolt 132 as viewed in FIG. 12, the central portions of the spring 148 will remain fixed with respect to carriage bolt 178 whereas the outer portions of the spring 148 will be drawn downwardly by the pivotable movement of the backrest bracket 172. As this action takes place, the handle 182 will actually pass through the opening 176 and the outer portions of the spring 148 will be drawn downwardly of the central portions thereof.

As seen from the foregoing, the invention can be used with different types of tilting chairs and secretarial chairs with tilting backrests, and executive posture chairs. In the latter case, a mechanical linkage would be provided between the tilting base and the backrest to achieve the tilting of the backrest with respect to the seat whereas the seat would have a tilt mechanism such as shown in FIGS. 1 through 7.

Reasonable variation and modification are possible within the scope of the foregoing disclosure and drawings without departing from the spirit of the invention which is defined in the accompanying claims.

The embodiments of the invention in which an exclusive property or privilege is claimed are defined as follows:

1. In a chair iron for controlling the tiling of a first chair part with respect to a support means, the chair iron having a first bracket means adapted to be connected to the first chair part, a second bracket means adapted to be connected to the support means, means pivotably mounting the first bracket means with respect to the second bracket means for tilting movement about a pivot axis, and means for biasing the first bracket means with respect to the second bracket means to a given rest position, the improvement which comprises:

said biasing means being a substantially flat coil spring having a plurality of increasingly smaller diameter coils; and means connecting said coil spring to said first and second bracket means such that said coil spring is axially extended against the spring tension at least during portions of tilting of the first bracket means with respect to the second bracket means, said coil spring having a central axis which is substantially perpendicular to the pivot axis.

2. A chair iron according to claim 1 and further comprising:

means mounting an outer portion of the coil spring on the first bracket means;

means coupling a central portion of the spring to the second bracket means such that the spring outer portion is moved away from the second bracket means against the tension in the spring as the first bracket means pivots with respect to the second bracket means.

3. A chair iron according to claim 2 wherein the central portion of the spring is raised with respect to the plane of the outer portions thereof and projects away from the second bracket means whereby the central portion of the spring moves through the outer portions thereof as the first bracket means pivots with respect to the second bracket means; and said first bracket means and outer spring portion mounting means are shaped so as to permit passage of the spring central portions through said spring outer portion for axial movement with respect thereto as the first bracket means pivots with respect to the second bracket means.

4. A chair iron according to claim 3 wherein the coupling means includes tension adjusting means for the spring and comprises a threaded bolt having retaining means at one end thereof, means for mounting the threaded bolt retaining means in abutting relationship to the central portion of the spring to maintain said bolt retaining means in engagement with the spring central portion.

5. A chair iron according to claim 4 and further comprising means to permit rotation of said bolt with respect to a given axis of the spring about the bolt mounting means as the axis of the spring rotates with respect to the second bracket means.

6. A chair iron according to claim 5 and further comprising an adjustable handle threaded on an opposite end of the bolt, the bottom portion of the handle abutting the underside of the second bracket means, and means for guiding rotation of the bolt with respect to the second bracket means upon rotation of the spring axis with respect to the second bracket means.

7. A chair iron according to claim 6 and further comprising a spindle mounted on the second bracket means; and the spring mounting means mounts the spring outer portion in a plane at an acute negative angle to a horizontal plane when the first bracket is in the given rest position such that the angle between the horizontal plane and the plane of the spring outer portion decreases and then increases to a positive angular direction as the second bracket means is pivoted with respect to the first bracket means, whereby the spring is loaded unevenly during the initial stages of pivoting but is loaded more evenly as the pivoting continues past the initial stages.

8. A chair iron according to claim 2 wherein the coupling means includes tension adjusting means for the spring, the tension adjusting means comprises a threaded bolt pivotably mounted at one end to the central portion of the spring and a handle adjustably threaded on the bolt, portions of the handle being in abutting relationship with an underside portion of the second bracket means; and means for guiding rotation of the bolt with respect to the second bracket upon rotation of the spring axis with respect to the second bracket means.

9. A chair iron according to claim 2 and further comprising a spindle mounted on the second bracket means; and wherein the spring mounting means mounts the spring outer portion in a plane at an acute negative angle to a horizontal plane when the first bracket means is in the given rest position such that the angle between the horizontal plane and the plane of the spring outer portion decreases and then increases in a positive angular direction as the second bracket means is pivoted with respect to the first bracket means, whereby the spring is loaded unevenly during the initial stages of pivoting but is loaded more evenly as pivoting continues.

10. A chair iron according to claim 2 wherein the central portion of the spring is raised with respect to the outer portion thereof and projects toward the second bracket means.

11. A chair iron according to claim 1 and further comprising means mounting an outer portion of the spring on the second bracket means; means coupling a central portion of the spring to the first bracket means.

12. A chair iron according to claim 11 and further comprising means on the second bracket means to permit passage of the central portion of the spring through portions of the second bracket means as the first bracket means tilts with respect to the second bracket means, wherein the central portion of the spring moves through outer portions thereof and through portions of the second bracket means during rotation of the first bracket means with respect to the second bracket means.

13. A chair iron according to claim 1 wherein the coil spring is concealed between the first and second bracket means.

14. A chair having a seat, a backrest, a base and a chair iron as defined in claim 1 coupling the base to the seat and backrest, the first bracket means of the chair iron is secured to the seat and the second bracket means of the chair iron is secured to the base whereby the seat tilts with respect to the base.

15. A chair having a seat, a backrest, a base and a chair iron as defined in claim 1, the first bracket means of the chair iron is secured to the backrest and the second bracket means of the chair iron is secured to the seat and to the base whereby the backrest pivots with respect to the seat and the base.

16. A chair iron for controlling tilting of a chair seat with respect to a support base, the chair iron having a first bracket means adapted to be secured to the chair seat; a second bracket means adapted to be secured to the chair base; means pivotably mounting the first bracket means with respect to the second bracket means; and means for biasing the first bracket means with respect to the second bracket means to a given rest position, the improvement which comprises:

the biasing means being a coil spring of increasingly smaller diameter and having a height-to-diameter ratio substantially less than 1;

means mounting the outer portion of the coil spring to the first bracket means in such a fashion so as to allow central portions of the spring to pass through the plane of the outer portions of the spring; and means coupling the central portion of the spring to the second bracket means, whereby tilting of the first bracket means with respect to the second bracket means occurs against the tension in the coil spring.

17. A chair iron according to claim 16 and further comprising means for guiding rotational movement of the coupling means with respect to the axis of the coil spring as the first bracket means pivots with respect to the second bracket means.

18. A chair iron according to claim 17 wherein the coupling means comprises means to adjust the tension in the coil spring.

* * * * *